United States Patent [19]

Smithers

[11] Patent Number: 4,719,831

[45] Date of Patent: Jan. 19, 1988

[54] BACON SLICING APPARATUS

[75] Inventor: James P. Smithers, Scottsdale, Ariz.

[73] Assignee: Conagra, Inc., Omaha, Nebr.

[21] Appl. No.: 4,956

[22] Filed: Jan. 20, 1987

Related U.S. Application Data

[63] Continuation of Ser. No. 456,659, Jan. 10, 1983, abandoned.

[51] Int. Cl.[4] ..... B26D 7/06

[52] U.S. Cl. ..... 83/355; 83/409; 83/422; 83/436; 83/447

[58] Field of Search ..... 83/156, 278, 420, 422, 83/423, 409, 436, 446, 447, 355, 356.1, 356.2, 356.3; 144/246 R, 246 F, 208 E, 242 C, 245 F, 246 C, 247, 250 A, 250 R; 198/722, 692, 693

[56] References Cited

U.S. PATENT DOCUMENTS

| | | | |
|---|---|---|---|
| 325,339 | 9/1885 | Hanavan | 144/246 C |
| 1,974,602 | 9/1934 | Dziedzic . | |
| 1,981,155 | 11/1934 | Stahly | 83/156 |
| 2,038,770 | 4/1936 | Straeten | 83/355 |
| 2,060,540 | 11/1936 | Straeten | 83/355 |
| 2,510,291 | 6/1950 | McLauchlan | 83/423 |
| 2,839,113 | 6/1958 | Townsend . | |
| 3,144,893 | 4/1964 | Dahms . | |
| 3,354,920 | 11/1964 | Hertwig . | |
| 3,414,031 | 12/1968 | Thomas . | |
| 3,502,127 | 3/1970 | Nathanson . | |
| 3,519,051 | 7/1970 | Badgley et al. . | |
| 3,542,105 | 11/1970 | Townsend | 146/241 |
| 3,580,308 | 5/1971 | Hamilton | 144/246 R |
| 3,846,957 | 11/1974 | Divan . | |
| 3,846,958 | 11/1974 | Divan . | |
| 3,880,035 | 4/1975 | Divan | 83/420 |
| 3,913,434 | 10/1975 | Smithers . | |
| 3,962,751 | 6/1976 | Wagner . | |
| 4,015,494 | 4/1977 | Spooner et al. | 83/76 |
| 4,151,772 | 5/1979 | Johnson | 83/355 |
| 4,179,987 | 12/1979 | Dohm . | |
| 4,188,870 | 2/1980 | Schill . | |
| 4,216,689 | 8/1980 | Suhling . | |
| 4,309,927 | 1/1982 | Dennis et al. . | |
| 4,321,847 | 3/1982 | Dillon . | |
| 4,329,900 | 5/1982 | Dennis et al. | 83/422 |
| 4,385,650 | 5/1983 | Schmidt | 198/692 |

*Primary Examiner*—E. R. Kazenske
*Assistant Examiner*—Hien H. Phan
*Attorney, Agent, or Firm*—Willian Brinks Olds Hofer Gilson & Lione Ltd.

[57] ABSTRACT

An apparatus and method for maintaining control over the orientation and position of the trailing end of a slab of bacon as the trailing end passes through a continuous bacon slicer, which apparatus and method involve depending from a linkage supported about multiple centers a controlled-rotation grip having backward-facing teeth, to serve to permit the grip to be maintained next to the slicing plane of the slicer even as the position of the lockable rotatable grip is vertically adjusted to accommodate bacon slabs of various thicknesses.

17 Claims, 8 Drawing Figures

BACON SLICING APPARATUS

CROSS REFERENCE TO RELATED APPLICATION

This application is a continuation of U.S. patent application Ser. No. 456,659, filed on Jan. 10, 1983 by the same inventor now abandoned.

BACKGROUND OF THE INVENTION

1. Field of the Invention

This invention relates to bacon slicing, and, more particularly, relates to an apparatus and method for maintaining the orientation of the end-piece of a slab of bacon as the slab passes through a continuous bacon slicer.

2. Description of the Prior Art

In the past, mechanical bacon slicers were developed to produce the precisely packaged drafts commonly found in the retail market. Initially, bacon slicers employed a reciprocating ram to feed a slab of bacon into the path of a slicing blade in slice-thickness steps. The ram positively gripped one end of the slab. The blade cut slices from the opposite end. When the ram reached the travel limit imposed by the blade, the ram was withdrawn, the end-piece was removed, a fresh slab was loaded into the slicer, and the process was repeated. While the ram-type slicer was relatively slow, it allowed nearly the entire slab to be fed through the blade. The positive grip on the end of the slab maintained the proper slicing orientation throughout the full length, producing a good slice-yield for each slab.

Subsequently, in an effort to speed-up the slicing process, continuous-type slicers were developed. A continuously advancing drive gripped the top and bottom of the slab, and continuously fed the slab forward into the path of the rotating blade. The relative timing between the feed rate of the drive and the rotational speed of the blade determined the slice thickness. The successive slices dropped onto a scale. When the scale indicated that the load of slices had reached the desired package weight, the advancing drive paused to permit removal of the accumulated slices from the scale.

As each slab neared the completion of its pass into the path of the slicing blade, the remaining end-piece traveled beyond contact with the drive. The following slab, however, continued to push the preceding end-piece into the blade path.

This gave rise to another problem; as the blade sliced through the end-piece, it tended to pull the remainder forward in an irregular manner. Once the end-piece had been dis-oriented, the succeding pass of the slicing blade produced a correspondingly irregular slice. As a result, continuous-type bacon slicers tended to produce an inordinate proportion of "ends and pieces", which has a substantially lower market value than did regular bacon slices. Since domestic bacon production exceeded millions of pounds per year, such a productivity loss had serious economic consequences.

In a series of attempts to control the attitude of the end-pieces as they passed through the slicer, a number of devices were introduced. One attempt to solve this problem is presented in U.S. Pat. No. 4,329,900, issued to Cashin Systems Corporation. That device employed a "hold down device", which included a single "rotatable gripper", or gripping driver, located next to the slicing blade. The gripper was mounted on a pivotally supported arm. The gripper started and stopped in synchronization with the drive for the bacon slab. The gripper helped to precisely feed the slab into the path of the slicing blade. Since the gripper advanced the slab slowly, at least in comparison to the speed of the blade, the gripper also tended to hold the slab stationary during the actual slicing operation. The loaded gripper thus held the slab back against the pull of the blade as the slicing operation took place.

Problems, however, still persisted; since the slabs of bacon varied in thickness, the pivotally supported arm had to swing the gripper up or down to accommodate the thickness of a particular slab. As the gripping driver pivoted about the radius of the arm, it moved from its position next to the plane of the slicing blade. The gripping driver moved farther away for a thinner slab. As a direct result, when thinner slabs were sliced an undesirably large proportion of "ends and pieces" were still produced.

A need continued to exist for an apparatus or method to more consistantly control the attitude of the end of each slab passing through a continuous-type bacon slicer, regardless of the relative thickness of any individual slab.

Another persisting problem arose due to the inability of the devices of the prior art to accomodate the thickness variations across the lateral dimension of a slab of bacon. The "lean" portion of the slab, taken from the belly-region of the hog, was generally thicker than the "fatback" portion of the slab, taken from the back-region of the hog. The "side" of the hog carcass was cured to produce a bacon slab. Before slicing, the cured slab was generally trimmed by removing a slice of the "backstrap" fat from the fatback portion.

As a result of the uneven thickness of a typical bacon slab, the singular grippers employed in the known devices of the prior art offered a degree of support for the lean portion of the slab, but tended to permit the blade to preferentially pull the fatback portion of the slab further into the path of the blade. Again, the result was often an inordinate proportion of irregular slices, which were not acceptable for inclusion in a display-case package.

A need continued to exist for an apparatus or method to control the attitude and forward motion of the full width of the face of a slab of bacon, as that face approached and encountered the slicing plane of a continuous-type bacon slicer.

Another shortcoming found in the grippers employed on the continuous bacon slicers in the past was a tendency of the teeth employed on the surface of the gripper to squeeze or propel the trailing end of a slab of bacon into the path of the slicing blade.

A need continued to exist for a tooth design for a gripping driver employed in a continuous-type bacon slicer, which tooth was specifically arranged to resist, or at least not contribute to, the forward progress of a trailing end of a slab, even when the gripper was loaded downward against the product.

A further problem persisting with the gripping driver devices found in the prior art was an inability to receive the first in a series of slabs of bacon, without manual assistance to aid in appropriately positioning the gripper. The problem arose because, when lowered to rest on the anvil of the continuous-type slicer, the gripper was also positioned so that the generally vertical leading surface of the first slab of bacon tended to frontally strike the gripper, thereby often resulting in a jam because the gripper was unable to ride onto the upper surface of the slab without manual assistance.

A need continued to exist for an apparatus or method to automatically shift a gripper, mounted adjacent to the slicing plane of a continuous-type bacon slicer, into a gripping engagement with the upper surface of an initial bacon slab, without requiring manual assistance.

SUMMARY OF THE INVENTION

Figure 1:
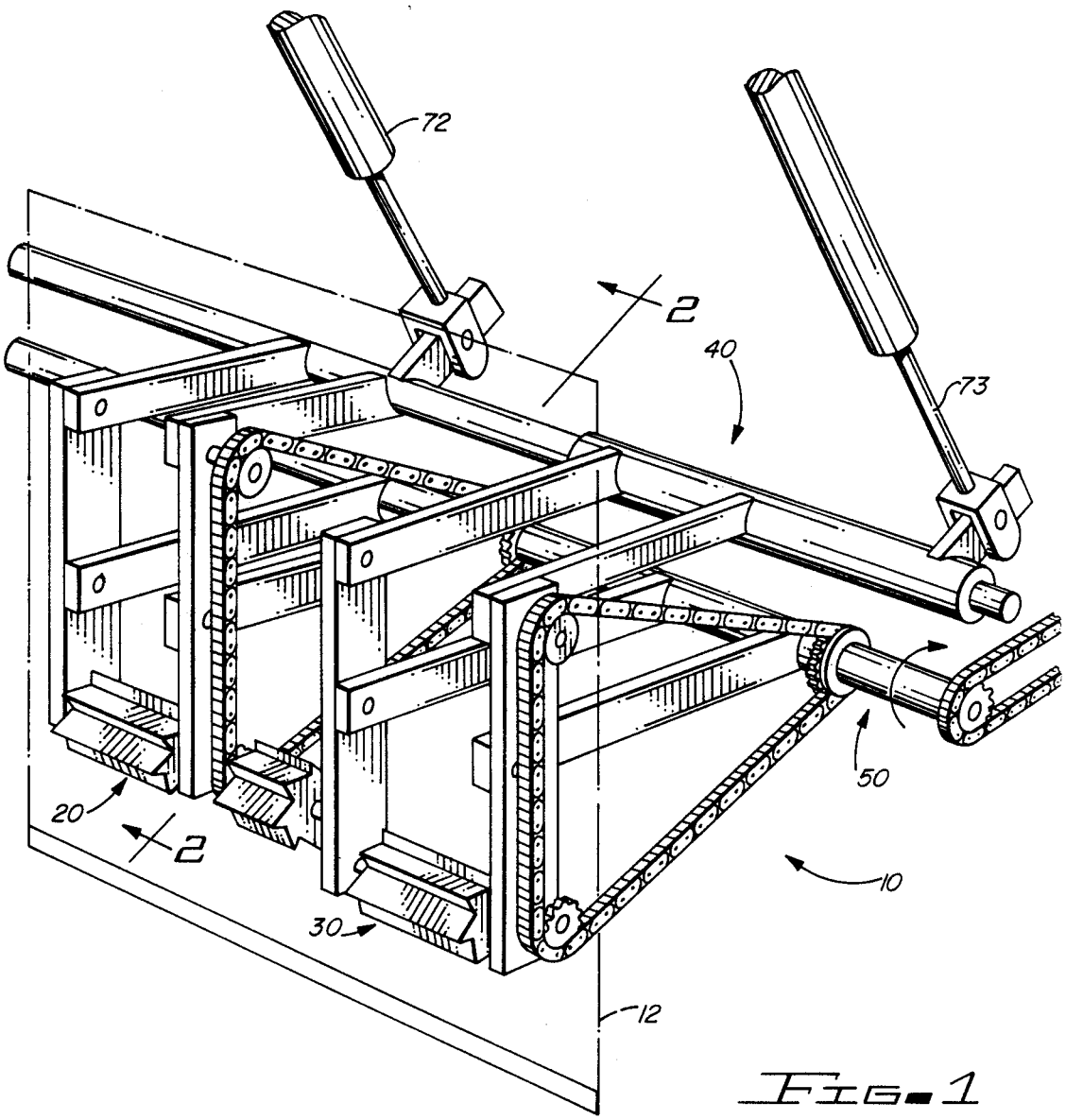
FIG. 1 is a perspective view of a control tractor apparatus.

In accord with a broadest aspect of the invention, it is an object to provide an improved drive for a continuous bacon slicer.

It is an object to provide a lockable grip for holding the end of a bacon slab against the pull of the slicing blade in a continuous-type bacon slicer.

It is another object to provide a linkage to maintain a gripping driver adjacent to the slicing plane of a continuous bacon slicer.

It is a further object to provide an adjustable, cantilevered support for a gripping driver mounted adjacent the slicing plane of a bacon slicer, which support employs a linkage supported about multiple centers to keep the gripping driver next to the slicing plane throughout the movement range required to accomodate bacon slabs of various thicknesses.

It is a further object to provide an adjustable, cantilevered support for a gripping driver mounted adjacent the slicing plane of a bacon slicer, which support employs a parallelogram mechanism to keep the gripping driver next to the slicing plane throughout the movement range required to accomodate bacon slabs of various thicknesses.

It is an object to provide a toothed roller for restraining a slab of bacon against the pull of the slicing blade in a continuous-type bacon slicer.

It is an object to teach a method for increasing the slice-yield produced by a continuous-type bacon slicer, by reducing the proportion of ends-and-pieces produced.

It is an object to teach an improved method for operating a continuous bacon slicer, by supporting a control tractor next to the slicing blade with an extended outer leg of a linkage having multiple support centers arranged to maintain the tractor close to the blade path as the linkage adjusts to accomodate bacon slabs of varying thicknesses.

It is an object to teach an improved method for operating a continuous bacon slicer, by supporting a control tractor next to the slicing blade with an extended outer leg of a parallelogram linkage arranged to maintain the tractor next to the blade path as the linkage adjusts to accomodate bacon slabs of varying thicknesses.

DESCRIPTION OF THE PREFERRED EMBODIMENTS

One embodiment of this invention employs dual tractors, mounted next to the slicing plane, to independently adjust to slab-thickness variations by elevating or lowering a lockable, rotating grip, while, at the same time, keeping each of the respective grips immediately next to the slicing plane.

In accord with an embodiment of this invention, an apparatus for controllably delivering to a slicing blade the entire length of a slab of bacon having a thickness within a range is disclosed, comprising: a grip located adjacent to the blade for propelling the slab into the path of the blade and further for gripping the slab as the blade cuts the slab so that the blade does not pull the slab further into the path of the blade; and suspension means including a linkage having multiple support centers for maintaining the grip near the blade as the linkage moves the grip to accommodate thicknesss within the range.

In accord with another embodiment of this invention, a lock for preventing a slicing blade from pulling a bacon slab further into the path of the blade is disclosed, comprising: grip means having a controllably locked rotatable grip located immediately adjacent the blade for permitting the slab to be fed into the path as the grip rotates forward: and the grip having backward-facing teeth so that the teeth tend to resist the forward-pulling force created as the blade cuts the slab.

In accord with a further embodiment of this invention, an improvement in a slicer for slicing a slab of bacon having a lockable rotary hold-down device mounted adjacent to the slicing blade is disclosed, comprising: ramp means coupled to the rotary hold-down device for lifting the rotary hold-down device into operational contact with the upper surface of the slab.

Yet another embodiment of this invention discloses a method for improving the feeding control over a trailing end of each of a plurality of varying-thickness bacon slabs as the end passes through a continuous bacon slicer, comprising the step of: suspending adjacent a slicing blade of the slicer a controlled rotation roller depending from a movable leg of a linkage having multiple support centers so that the roller can stay both adjacent to the slicing blade and in lockable contact with each of the slabs even as the leg moves to accomodate the thickness variations to thereby prevent the slicing blade from pulling the end into the path of the blade.

In accord with another aspect of this invention, an improvement in a slicing-blade-adjacent gripping driver of bacon slicer is disclosed, comprising: the gripping driver including at least a holding tooth; the holding tooth having an apex formed in part by a planar face lying in a radial relationship with the axis of the driver; and the planar face having a frontal exposure to oncoming slabs of bacon.

The foregoing and other objects, features and advantages will be apparent from the following, more particular, description of the preferred embodiments of the invention, as illustrated in the accompanying drawings.

THE SPECIFICATION

FIG. 1 is a perspective elevational view of a control tractor apparatus, shown generally by reference number 10. The apparatus 10 is mounted within a continuous bacon slicer 12, which is represented by the phantom outline of an opening in the frame of the slicer 12. The apparatus 10 maintains the alignment of a slab of bacon as slices are cut from one end.

As shown in its preferred embodiment, the apparatus includes two separate tractors 28, 30, which are respectively identified herein as the "lean-tractor" and the "fatback-tractor". As shown, the tractors 20, 30 are free to operate at different elevations, by independently adjusting to the different thickness of the corresponding lean- and fatback-regions of a slab of bacon. The use of the dual tractors 20, 30 improves the control over the slicing operation as the bacon slabs move through the slicer 12. Each of the tractors 20, 30 is supported by the combination of a pivot shaft assembly 40 and a driving shaft assembly 50.

Figure 2:
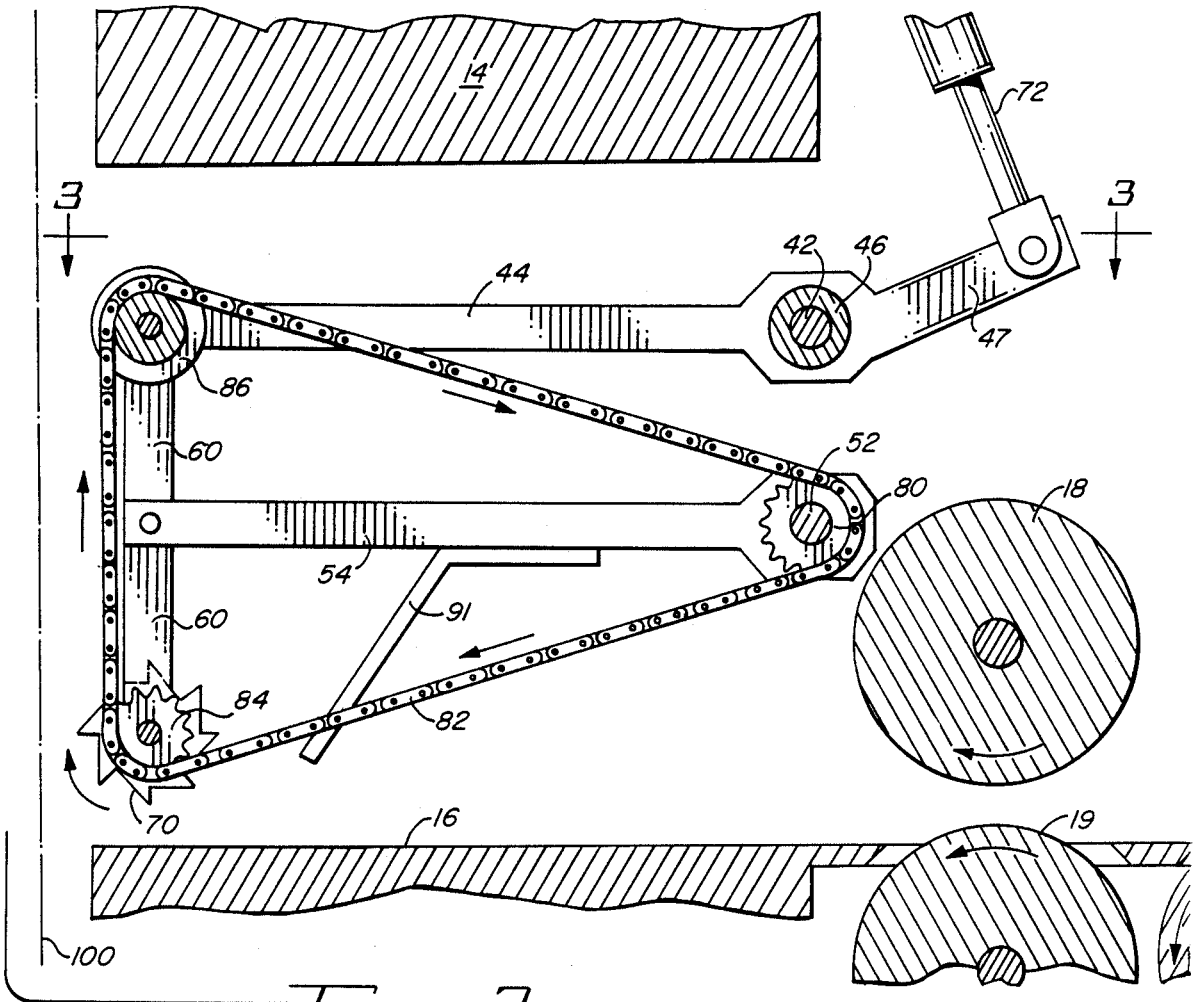
FIG. 2 is an elevational view taken along line 2—2 in FIG. 1.

Referring also to FIG. 2, a sectional view taken along line 2—2 in FIG. 1 is shown. The bacon slicer 12 has a rigid frame 14, which defines an anvil 16 to support the bacon slabs as they proceed through the slicer 12. The frame 14 also supports power-driven feed rollers 18, 19 and a rotating slicing blade (not shown). The slicing blade rotates in a plane as identified by reference number 100. The rollers 18, 19 rotate to drive each slab of bacon into the slicing plane 100. The rollers 18, 19 rotate nearly continuously, pausing only to permit a controller (not shown) to calculate the number of slices required to complete a partial draft of slices lying on a sensing scale (not shown), or to permit the completed draft to be cleared from the weighing scale.

The respective pivot and driver shaft assemblies 40, 50 are supported by the frame 14. The pivot shaft assembly 40 includes a pivot shaft 42. The pivot shaft 42 is rotatably mounted in frame-supported bearings (not shown). The pivot shaft 42 supports four upper arms, shown typically by reference number 44. The upper arms 44 are mounted in rigidly linked pairs. Each of the linked pairs functions as a part of either the lean-tractor 20 or the fatback-tractor 30.

Figure 3:
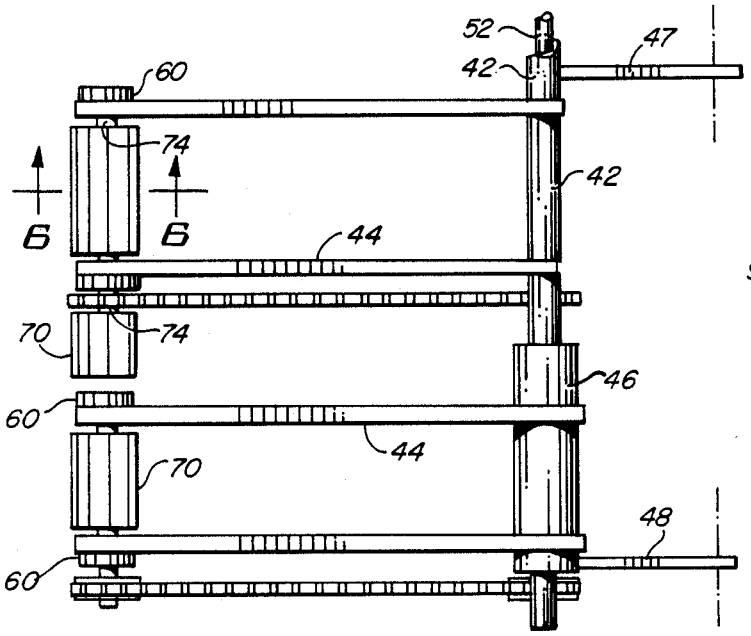
FIG. 3 is a plan view taken along line 3—3 in FIG. 2.

Referring also to FIG. 3, it can be seen that the pivot shaft 42 couples the pair of arms 44 that constitute portions of the lean-tractor 20. A rotatable sleeve 46, mounted upon the pivot shaft 42, forms the connection between the pair of the arms 44 that constitute portions of the fatback tractor 38. A shaft lever 47 and a sleeve lever 48 are respectively connected to the pivot shaft 42 and the sleeve 46, and correspondingly permit the pivot shaft 42 and the sleeve 46 to be independently rotated about a common axis.

The driver shaft assembly 50 includes a driver shaft 52. The driver shaft 52 supports a number of lower arms, a typical one of which is shown by reference number 54. Each of the lower arms 54 is rotationally free with respect to the driver shaft 52, and is positioned directly below a corresponding one of the upper arms 44. The lower arms 54 are cooperatively coupled in corresponding pairs, to operate as components of the lean- and fatback-tractors 20, 30.

The pivot shaft 42 and the driver shaft 52 constitute stationary pin connections, respectively supporting the upper and lower arms 44, 54.

A movable leg, typically shown by reference number 60, is pivotally connected by pin connections 62 (See FIG. 5) to both link the unsupported outboard ends of each pair of the vertically aligned sets of upper and lower arms 44, 54, and to contribute rotatable support for at least one grip, or gripping driver, 70. In the preferred embodiment of the apparatus 10, the axis formed by the supporting pivot and driving shafts 42, 52, the leg 60 and the upper and lower arms 44, 54 cooperate to form a hinged parallelogram linkage or mechanism. A depending, extended lower portion of each of the legs 60 provides the rotatable support for at least one of the gripping drivers 70. As shown in the preferred embodiment, the legs 60 of the lean-tractor 20 support two of the gripping drivers 70, while the legs 60 of the fatback tractor 30 support only a single one of the gripping drivers 70.

Figure 5:
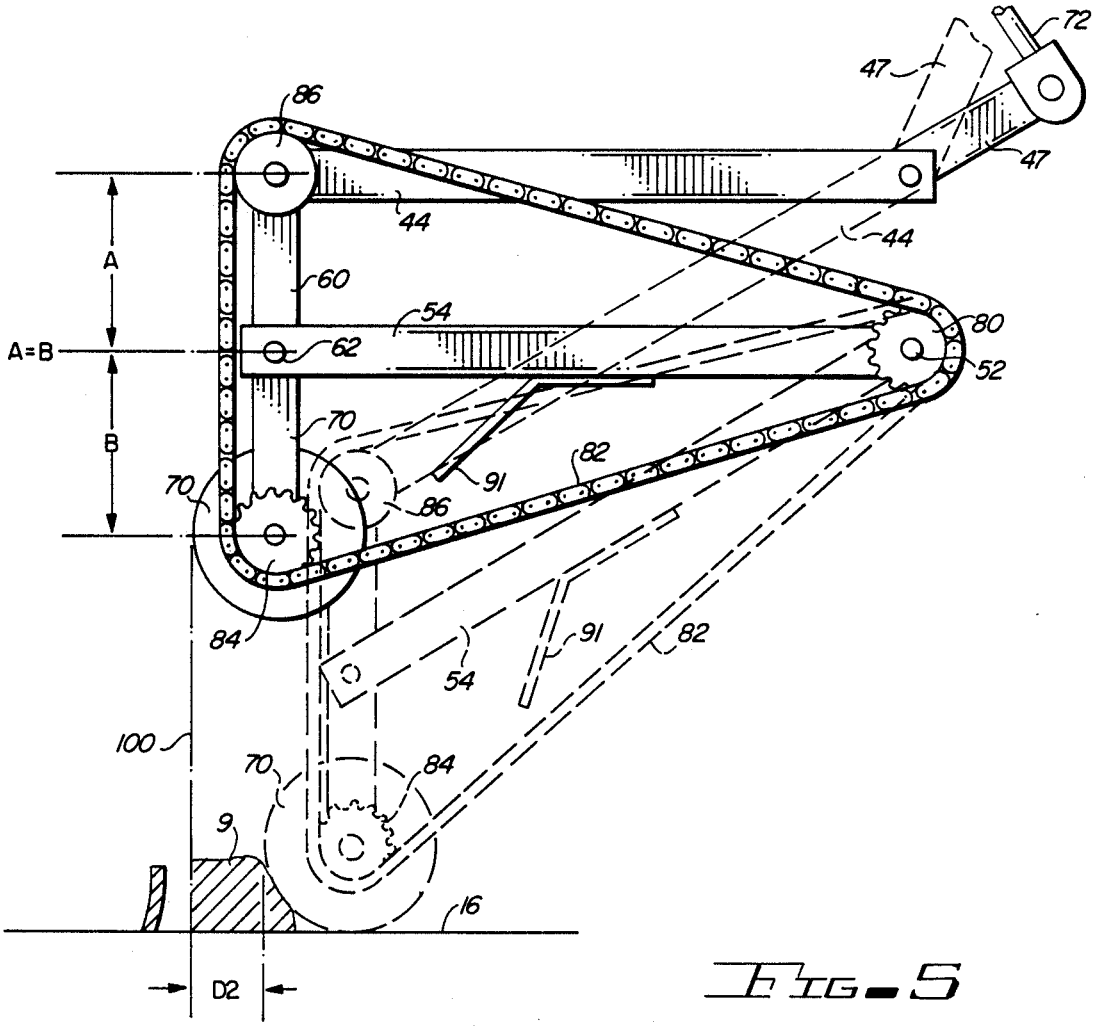
FIG. 5 is an elevational view of one of the aspects employed by the device of FIG. 1 to solve the problem persisting with the devices found in the prior art.

As best shown in FIG. 5, the rigid linkage between the pairs of upper arms 44, the respective pin connections 62 between the leg 60 and the upper and lower arms 44, 54, and the rotating connection between the lower arms 54 and the lower shaft 52, in combination permit extensible linear actuators 72, 73 (See also FIG. 2) to control the attitude of the parallelogram linkage. In effect, the frame functions as one of the legs of the parallelogram.

The separate linear actuators 72, 73 are positioned between the frame 14 and the respective shaft arm 47 and sleeve arm 48, to permit the attitude of the lean- and fatback-tractor assemblies 20, 30 to be independently controlled. Thus the lean- and fatback-tractor assemblies 20, 30 can be readily adjusted to adapt to bacon slabs having differing sectional thicknesses in the lean- and fatback-regions.

The actuators 72, 73 can also forcibly load the tractors 20, 30 to press the gripping drivers 70 against the slab of bacon, thereby providing sufficent frictional and mechanical engagement between the bacon slab and the gripping drivers 70 so as to permit the slab to be either propelled into, or locked with respect to, the slicing plane 100.

In the preferred embodiment of the apparatus 10, the linear actuators 72 are pneumatic cylinders, loaded to exert a constant pressure during operation.

Figure 4:
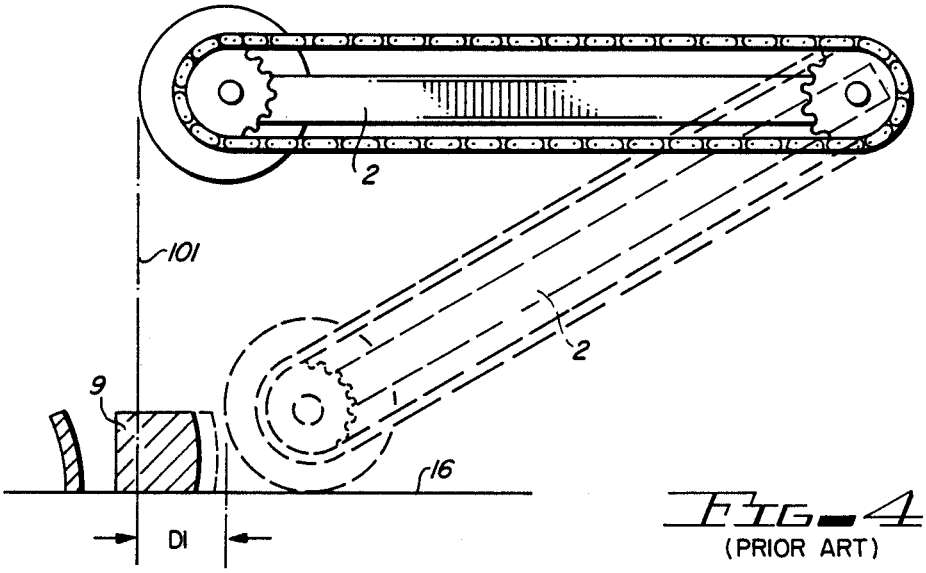
FIG. 4 (PRIOR ART)
FIG. 4 is an elevational view showing a problem persisting with the devices of the prior art.

As explained more fully in conjunction with FIGS. 4 and 5, the support of the gripping driver 70 upon the extended leg 60 of a parallelogram mechanism provides a particular advantage for the apparatus 10: it permits the gripping driver 70 to be kept in position very near to the slicing plane 100, despite the movement required to accomodate the thickness variations normally encountered between various slabs of bacon passing through the slicer 12.

A driving sprocket 80 is rigidly mounted upon the driving shaft 52. The driving sprocket 80 engages a chain 82, which in turn engages a driven sproket 84 and an idler 86. The driven sprocket 84 is fixedly connected to the gripping driver 70, to permit the driving shaft 52 to control the rotation of the gripping driver 70. In the preferred embodiment, the driving shaft 52 is mechanically connected to the driving mechanism (not shown) for the feed rollers 18, 19, thereby synchronizing the operation of the gripping driver 70 with the advancement of the bacon slabs by the feed rollers 18, 19.

The combination of FIGS. 4 and 5 illustrates two principal advantages of this invention over the known devices used in the past.

Referring specifically to FIG. 4, it can be seen that the control tractor, as previously used, utilized a pivoting arm 2 to support a gripping driver 4. As the arm 2 pivoted to accomodate bacon slabs of various thicknesses, the gripping driver 4 was correspondingly displaced from a plane 101 of the slicing blade. This in turn reduced the support available to the slab as it neared the slicing blade.

The blade-adjacent support for the slab became critically important as an end of each slab, as shown by reference number 9, approached the blade. Once the slab-end 9 passed beyond the reach of the gripping driver 4, as shown by the dashed lines in FIG. 4, the next stroke of the slicing blade pulled at least part of the slab-end 9 forward an unpredictible distance, as shown in FIG. 4 by the solid lines. This often doomed the remainder of the slab to the lower-value "ends and pieces" classification, because a subsequent stroke of the blade necessarily sliced an unpredictibly irregular portion. The problem was particularly acute in the case of thin slabs of bacon, since the gripping driver 4 had to pivot downward a substantial degree to maintain a gripping contact with the slab, and as it did so it moved a considerable distance, as shown by label D1, away from the slicing plane 101.

In FIG. 5, it can be seen that the use of a linkage supported by multiple centers is clearly superior in its ability to maintain the gripping driver 70 adjacent to the slicing blade. The illustrated apparatus 10 employs a parallelogram linkage. In light of the advantage disclosed herein, those skilled in the art will readily perceive alternate linkages, such as, for example, a trapezoid linkage supported on multiple centers, could accomplish the same objective.

In the illustrated embodiment of a parallelogram linkage supported on multiple centers, the projecting leg 60 keeps the gripping driver 70 close to the plane 100 of the slicing blade, even as the pin connections 62 supporting the leg 60 are swung away from the plane 100 of the slicing blade. The lateral displacement of the gripping driver 70 is thereby minimized. Since the gripping driver 70 remains close to the slicing plane 100, as shown by label D2, the apparatus 10 is better able to provide support for the trailing end 9 of even a relatively thin slab of bacon.

The seemingly minor dimensional change is in fact highly significant: the ability of the apparatus 10 to contribute one or more additional slices to the yield from each slab of bacon results in a tremendous saving when the huge volume of domestic bacon production is taken into account. FIG. 4 clearly shows the en -piece 9 that the gripping driver 4 is unable to control, and FIG. 5 shows with equal clarity that the the gripping driver 70 of the control tractor 10 is fully able to maintain a grip on the end-piece 9.

Further, by making the rotational centers for the gripping driver 70 and the idler 86 equidistant from the particular pin connection 62 supported by the lower arm 54, the geometry obviates the need for a floating tensioner to keep the chain 82 taut as the apparatus 10 adjusts to accomodate various bacon slab thicknesses.

Also shown in FIG. 5 are ramps, a typical one of which is shown by reference number 91, which are positioned to ride on the upper edge of a first slab of bacon entering the slicer 12, and to thereby lift the gripping driver 70 onto the upper surface of the slab without any requirement for manual assistance.

Figure 6:
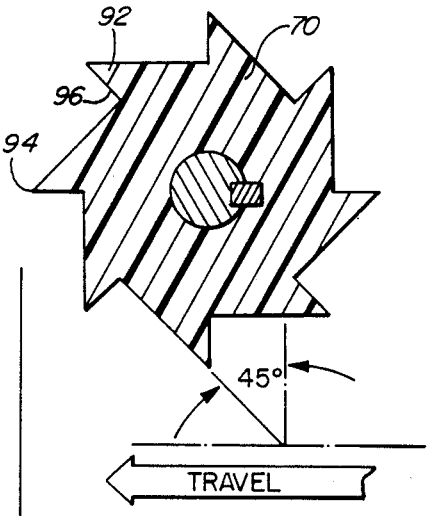
FIG. 6 is a sectional view of one of the gripping drivers of the tractor apparatus of FIG. 1.

FIG. 6 shows a sectional view of the preferred embodiment of the gripping driver 70, taken along line 6—6 in FIG. 3. The gripping driver 70 has at least a hook-shaped holding tooth 92, having an apex 94 formed by a planar face 96. The planar face 96 lies in a radial orientation with respect to the axis of the gripping driver 70, and thereby avoids "squeezing" the slab of bacon forward toward the slicing plane 100, even when the tooth 92 is only engaging the very hind-most portion of the slab. The teeth 92 face "backwards", with respect to the feed direction for the slabs, to thereby permit the gripping driver 70 to perform its principal function of hooking and holding the end of a given slab against the pull of the slicing blade. When in a vertical position, the planar face 96 lies in a perpendicular relationship with, and has having a full exposure to, oncoming slabs of bacon. The shape of the tooth 92 is such that, when pressed downward against the slab, even the teeth 92 that have rotated beyond a vertical positon exhibit no tendency to force the slab or the slab-end forward into the path of the slicing blade.

Figure 7:
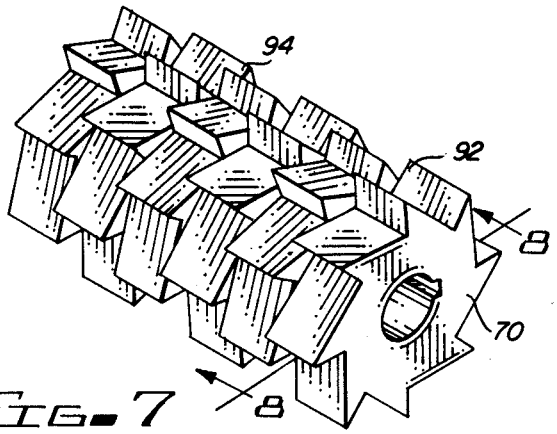
FIG. 7 is a perspective view of an alternate configuration for one of the gripping drivers of the tractor apparatus of FIG. 1.

FIG. 7 shows a perspective view of an alternate configuration for a gripping driver 70 employing the backward facing teeth 92 of FIG. 6, wherein the adjacent portions of the gripping driver 70 have been segmented and indexed so as to provide additional points of gripping contact with the slab of bacon as it passes beneath the gripping driver 70. The staggered configuration of the teeth 92 helps assure that at least one of the apexes 94 enjoys a gripping engagement with the surface of the bacon slab at all times.

Figure 8:
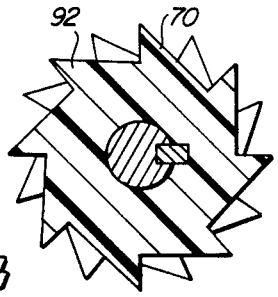
FIG. 8 is a sectional view taken along line 8—8 in FIG. 7.

FIG. 8 is a sectional view taken along line 8—8 in FIG. 7, illustrating the particular indexing relationship employed therein.

In use, the control tractor apparatus 10 is arranged to replace the control tractor currently employed on conventional continuous-type bacon slicers. The gripping drivers 70, as well as the supporting linkage assembly, can be readily inserted into the tunnel defined by the frame 14 of a conventional bacon slicer, such as the Cashin Systems Corporation Model No. 3027 or an Anco Model 827C. The control tractor apparatus 10 can then be secured in place, and provided with appropriate mechanical drives for the driving shaft 52 and the linear actuators 72, whereupon the device 10 is ready for use.

The ramps 91 permits an automated start-up of the slicer 12, with the control tractor apparatus 10 in place. The gripping driver 70 is kept adjacent to the slicing plane 100 by the parallelogram linkage of the control tractor apparatus 10, to thereby improve the slice-yield from trailing end of each slab. The configuration of the teeth 92 employed on the gripping driver 70 assists in holding the trailing end of each slab against the pull of the slicing blade, again contributing to slice-yield. The separately floating lean- and fatback-tractors 20, 30 permit the full width of the slab of bacon to be evenly supported, further contributing to the slice-yield of a given slab of bacon. Thus, employing the foregoing in combination, the control tractor 10 improves the productivity of a continuous-type bacon slicer.

While the invention has been particularly shown and described with reference to preferred embodiments thereof, it will be understood and appreciated those skilled in the art that changes in form and detail, as well as omissions, may be made in the described structure and method without departing from the spirit and scope of the invention.

I claim:

1. In an apparatus for controllably delivering a slab of bacon to a slicing blade, the improvement comprising:

a support shaft mounted to the apparatus;

a drive shaft mounted to the apparatus parallel to the support shaft;

a first pair of arms mounted so as to pivot about the support shaft in unison;

a second pair of arms mounted so as to pivot about the drive shaft in unison;

a pair of legs, each leg pivotally mounted to a first arm of the first pair of arm at a first pivot point and pivotally mounted to a second arm of the second pair of arm at a second pivot point, wherein each leg comprises a lower portion extending below the first and second pivot point;

a feed roller having an axis of rotation parallel to the support shaft and being rotatably mounted to the lower end of each leg;

a drive sprocket affixed to the drive shaft;

a drive loop cooperating with the drive sprocket to drive the feed roller;

whereby said feed roller is adapted to move vertically while minimizing variations in spacing between the blade and the feed roller.

2. The invention of claim 1 wherein the support shaft is above the drive shaft.

3. The invention of claim 1 wherein the roller defines an array of teeth, and wherein each of said teeth defines front and rear faces meeting at an apex and shaped such that, for a selected slab engaging position of each of the teeth, lines toward the apex along both the front and rear faces of the bottommost tooth would not intersect a plane containing the blade.

4. The invention of claim 1 further comprising ramp means affixed to at least one of said arms which ramp means is configured and positioned so as to contact a leading edge of the slab and thereby automatically lift the feed roller into a position to engage the slab.

5. The invention of claim 1 further comprising actuator means for controllably rotating the first pair of arms about the support shaft and the second pair of arms about the drive shaft in order to bias the feed roller against the slab of bacon.

6. In an apparatus for controllably delivering a slab of bacon to a slicing blade, the improvement comprising:

a support shaft mounted to the apparatus;

a drive shaft mounted to the apparatus parallel to the support shaft;

a first pair of arms mounted so as to pivot about the support shaft in unison and a second pair of arms mounted so as to pivot about the support shaft in unison and independently of said first pair of arms;

a third pair of arms mounted so as to pivot about the drive shaft in unison and a fourth pair of arms mounted so as to pivot about the drive shaft in unison and independently of the third pair of arms;

a first pair of legs, each leg pivotally mounted about a first pivot point to one arm of said first pair of arms and pivotally mounted about a second pivot point to one arm of said third pair of arms wherein each leg of said first pair of legs comprises a lower portion which extends below said first and second pivot points;

a second pair of legs which are each pivotally mounted about a third pivot point to one arm of said pair of arms and pivotally mounted about a fourth pivot point to one arm of said fourth pair of arms wherein each leg of said second pair of legs comprises a lower portion which extends below said third and fourth pivot points;

a first feed roller having an axis of rotation parallel to the support shaft and being rotatably mounted to the lower portion of each leg of said first pair of legs, and a second feed roller having an axis of rotation parallel to the support shaft and the drive shaft and being rotatably mounted to the lower portion of each leg of said second pair of legs;

a first drive sprocket affixed to the drive shaft, and a second drive sprocket affixed to the drive shaft, whereby said first and second drive sprockets are rotated in unison upon rotation of the drive shaft;

a first drive loop cooperating with the first drive sprocket to drive the first feed roller, and a second drive loop cooperating with the second drive sprocket to drive the second feed roller;

whereby said first feed roller is adapted to move vertically and said second feed roller is adapted to move vertically independently of the first feed roller to thereby accommodate different thicknesses in the slab;

whereby said first and second feed rollers are adapted to move vertically while minimizing variations in spacing between the blade and the feed rollers; and whereby said first and second feed rollers are adapted to be driven in unison.

7. The invention of claim 6 wherein the support shaft is above the drive shaft.

8. The invention of claim 6 wherein each of the rollers defines an array of teeth, and wherein each of said teeth defines front and rear faces meeting at an apex and shaped such that, for a selected slab engaging position of each of the teeth, lines toward the apex along both the front and rear faces of the bottommost tooth would not intersect a plane containing the blade.

9. The invention of claim 6 further comprising ramp means affixed to at least one of said arms which ramp means is configured and positioned so as to contact a leading edge of the slab and thereby automatically lift at least one of the feed rollers into a position to engage the slab.

10. The invention of claim 6 further comprising a first actuator means for controllably rotating the first pair of arms about the support shaft and the third pair of arms about the drive shaft in order to bias the first feed roller against the slab of bacon and a second actuator means for controllably and independently rotating the second pair of arms about the support shaft and the fourth pair of arms about the drive shaft in order to bias the second feed roller against the slab of bacon.

11. In an apparatus for controllably delivering a slab of bacon to a slicing blade, the improvement comprising:

at least two feed devices, each having a driveable roller with a surface adapted to mechanically engage a surface of the slab of bacon and to securely hold it in place adjacent to the cutting blade, wherein each of the rollers defines an array of teeth, and wherein each of said teeth defines front and rear faces meeting at an apex and shaped such that, for a selected slab engaging position of each of the teeth, lines toward the apex along both the front and rear faces of the bottommost tooth would not intersect a plane containing the blade;

means for supporting the two feed devices such that the two feed devices are positioned at a common separation from the blade to move independently to accommodate variation in thickness of the slab parallel to the blade; and means for selectively driving the rollers of the two feed devices in unison to advance the slab toward the blade.

12. The invention of claim 11 wherein the rear face of each of the teeth is oriented substantially radially.

13. The invention of claim 11 wherein the supporting means comprises a pair of linkages, each coupled to a respective one of the feed devices, and each having multiple support centers arranged to maintain the respective feed device near said blade as said linkage allows said feed device to accommodate changes in thickness of the slab of bacon.

14. The invention of claim 11 further comprising:

at least one ramp mounted to the supporting means, said ramp positioned to contact a leading edge of the slab as it approaches the blade in order automatically to lift the feed devices into an operational position in which the feed devices engage an upper surface of the slab.

15. In an apparatus for controllably delivering a slab of bacom to a slicing blade, the improvement comprising:

at least one feed device having a driveable roller with a surface adapted to mechanically engage a surface of the slab of bacon and to securely hold it in place adjacent to the slicing blade, wherein the roller defines an array of teeth, and wherein each of said teeth defines front and rear faces meeting at an apex and shaped such that, for a selected slab engaging position of each of the teeth, lines toward the apex along both the front and rear faces of the bottommost tooth would not intersect a plane containing the blade;

means for supporting the feed device, said supporting means comprising a linkage coupled to the feed device and having multiple support centers arranged to maintain the feed device near the blade as the linkage allows the feed device to accommodate variations in thickness of the slab parallel to the blade;

means for driving the roller of the feed device to advance the slab toward the blade; and a ramp, mounted to the supporting means to contact a leading edge of the slab as it approaches the blade in order automatically to lift the roller of the feed device into an operational position in which the feed device engages an upper surface of the slab.

16. The invention of claim 15 wherein the rear face of each of the teeth is oriented substantially radially.

17. The invention of claim 15 wherein each of the feed rollers comprises a plurality of toothed wheels which are staggered rotationally with respect to one another such that the teeth of each wheel are out of alignment with the teeth of the adjacent wheels.

* * * * *

UNITED STATES PATENT AND TRADEMARK OFFICE

CERTIFICATE OF CORRECTION

PATENT NO. : 4,719,831

DATED : January 19, 1988

INVENTOR(S) : James P. Smithers

It is certified that error appears in the above-identified patent and that said Letters Patent is hereby corrected as shown below:

IN THE BACKGROUND OF THE INVENTION

In column 1, line 55, please delete "has" and substitute therefor --had--.

IN THE BRIEF DESCRIPTION OF THE DRAWINGS

In column 3, line 9, please delete "DRAWING" and substitute therefor --DRAWINGS--.

IN THE SPECIFICATION

In column 5, line 11, please delete "28" and substitute therefor --20--.

In column 5, line 50, please delete "38" and substitute therefor --30--.

In column 6, line 49, please delete "accomodate" and substitute therefor --accommodate--.

In column 7, line 1, please delete "accomodate" and substitute therefor --accommodate--.

UNITED STATES PATENT AND TRADEMARK OFFICE

CERTIFICATE OF CORRECTION

PATENT NO. : 4,719,831

DATED : January 19, 1988

INVENTOR(S) : James P. Smithers

It is certified that error appears in the above-identified patent and that said Letters Patent is hereby corrected as shown below:

In column 7, line 48, please delete "en" and substitute therefor --end--.

In column 7, line 50, please delete the second occurrence of "the".

In column 7, line 58, please delete "accomodate" and substitute therefor --accommodate--.

In column 8, line 43, please delete "permits" and substitute therefor --permit--.

In column 8, line 60, after "appreciated" please insert --by--.

In column 9, line 8, please delete "arm" and substitute therefor --arms--.

In column 9, line 10, please delete "arm" and substitute therefor --arms--.

Signed and Sealed this

Fourth Day of July, 1989

*Attest:*

*Attesting Officer*

DONALD J. QUIGG

*Commissioner of Patents and Trademarks*